US008009857B2

(12) United States Patent
Bohlender et al.

(10) Patent No.: US 8,009,857 B2
(45) Date of Patent: Aug. 30, 2011

(54) INDUCTION MOTOR FOR LOUDSPEAKER

(75) Inventors: Jack T. Bohlender, Carson City, NV (US); Thilo Christian Stompler, La Jolla, CA (US); David J. Graebener, Reno, NV (US); David J. Michno, Carson City, NV (US); Robert M. Smith, Gardnerville, NV (US)

(73) Assignee: Wisdom Audio Corp., Carson City, NV (US)

( * ) Notice: Subject to any disclaimer, the term of this patent is extended or adjusted under 35 U.S.C. 154(b) by 1232 days.

(21) Appl. No.: 11/706,546

(22) Filed: Feb. 15, 2007

(65) Prior Publication Data

US 2008/0199039 A1 Aug. 21, 2008

(51) Int. Cl.
*H04R 1/00* (2006.01)
*H04R 9/06* (2006.01)
*H04R 11/02* (2006.01)

(52) U.S. Cl. ..... 381/400; 381/401; 381/412

(58) Field of Classification Search ..... 381/396, 381/400–406, 408, 409, 412; 310/15, 12.24, 310/216.067, 43, 44
See application file for complete search history.

(56) References Cited

U.S. PATENT DOCUMENTS

| | | | |
|---|---|---|---|
| 2,621,261 | A | 12/1952 | Karlsson et al. |
| 3,725,521 | A | 4/1973 | Ebling |
| 3,953,687 | A | 4/1976 | Carbonneau |
| 4,965,839 | A | 10/1990 | Elieli |
| 5,062,140 | A | 10/1991 | Inanaga et al. |
| 5,197,104 | A | 3/1993 | Padi |
| 5,742,696 | A | 4/1998 | Walton |
| 6,359,996 | B1 | 3/2002 | Ohashi |
| 6,542,617 | B1 | 4/2003 | Fujihira et al. |

OTHER PUBLICATIONS

"Super Linear Magnet Technology", ATC Technical Document vol. 1 Issue 1, Aug. 1997 http://www.atc.gb.net/technology/Super_Linear_Technical.zip.

http://atc.gb.net/intro.html, Apr. 22, 2003.

http://www.electronics-tutorials.com/basics/toroids.htm, Apr. 6, 2003.

http://en.wikipedia.org/wiki/Powdered_core, Feb. 13, 2007. http://en.wikipedia.org/wiki/Magnetic_core (same), Feb. 13, 2007.

http://en.wikipedia.org/wiki/Carbonyl_iron, Feb. 13, 2007.

http://www.sumitomometals.co.jp/e/news/news2002-02-25.html.

http://www.roger-russell.com/xl1w.htm, Jul. 13, 2003.

http://www.soundonsound.com/sos/1997_articles/oct97/atcscm20a.html.

*Primary Examiner* — Tuan D Nguyen

(74) *Attorney, Agent, or Firm* — Richard Calderwood

(57) ABSTRACT

An audio loudspeaker having an induction motor whose yoke components are formed of powdered iron or other material which is highly magnetically permeable and highly electrically resistive. The oscillating magnetic flux caused by the alternating current applied to the primary coil induces eddy currents in the shorted turn secondary coil but not in the yoke components. This reduces heating of the yoke components, reduces flux modulation, and reduces wasted power.

21 Claims, 16 Drawing Sheets

220

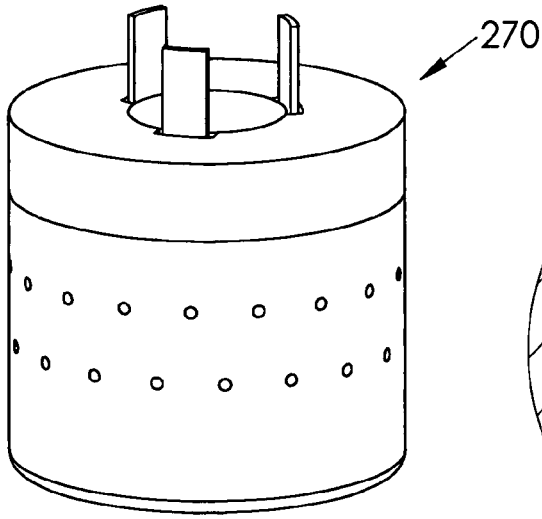
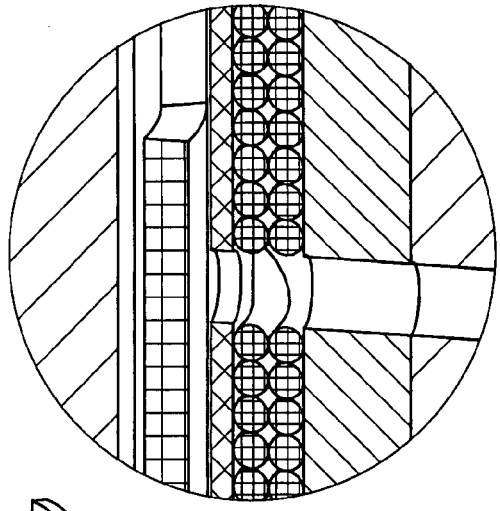
Fig. 16
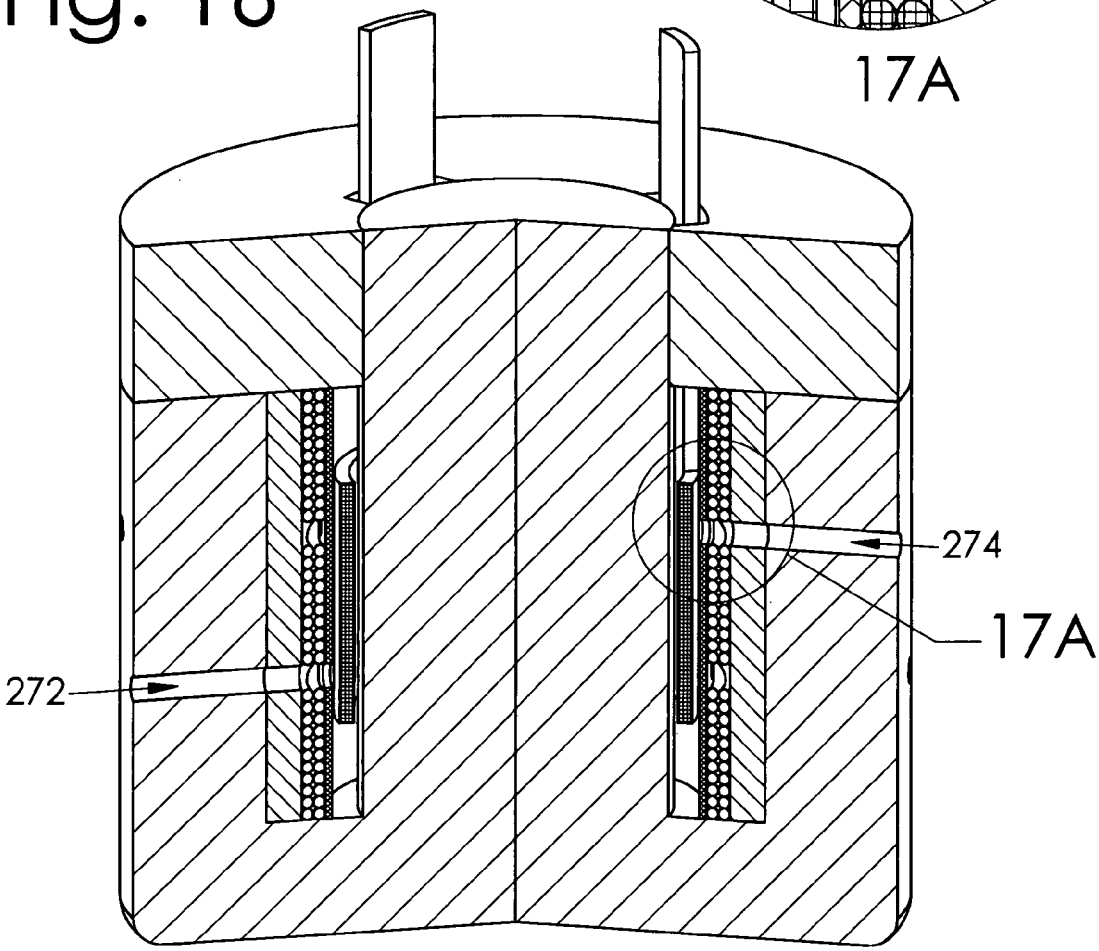
270 Fig. 17

INDUCTION MOTOR FOR LOUDSPEAKER

BACKGROUND OF THE INVENTION

1. Technical Field of the Invention

This invention relates generally to electromagnetic transducer motor structures, and more specifically to the material composition of the yoke and other steel parts in the magnetic circuit of an induction motor for a transducer such as a loudspeaker or a microphone.

2. Background Art

Electromagnetic transducers utilize a variety of different types of motors. The most common of these is the moving coil motor, in which a magnetic circuit provides magnetic flux over a magnetic air gap, and an alternating current voice signal is applied to a multi-winding voice coil suspended in the magnetic air gap; the alternating current voice coil signal generates an oscillating magnetic field which interacts with the magnetic circuit's flux in the air gap, causing the voice coil to oscillate axially within the air gap, in turn driving the diaphragm assembly and generating acoustic waves corresponding to the voice signal.

A much less common type of motor is the induction motor, in which a magnetic circuit provides magnetic flux over a magnetic air gap, and an alternating current voice signal is applied to a stationary multi-winding primary coil disposed somewhere in the magnetic circuit; the alternating current voice signal causes the magnetic flux in the air gap to oscillate, which induces an alternating current in a "shorted turn" single-turn coil disposed in the magnetic air gap. The alternating current in the shorted turn generates an oscillating magnetic field, which interacts with the magnetic circuit's flux in the air gap, causing the shorted turn to oscillate axially within the air gap, in turn driving the diaphragm assembly to generate acoustic waves corresponding to the voice signal.

The induction motor is, in some sense, akin to an electrical transformer, in that it has a primary coil which is inductively coupled to a secondary coil (the shorted turn), and a ferrous yoke that supports the primary coil (and the secondary coil in the case of a transformer).

An early induction motor was taught in U.S. Pat. No. 2,621,261 to Karlsson et al., who discovered that "the [moving] coil may constitute one of the windings of a transformer, the iron circuit of which wholly or partly consists of the magnetic circuit." Karlsson used "one short-circuited strip of copper" as his shorted turn, moving secondary coil. Karlsson further taught that "in order to reduce the losses of the iron circuit of the transformer, the [pole piece, cap, and cup yoke] are formed from a so called free cutting steel, which has been treated in a suitable way." Free cutting steel (FCS) is steel which includes additives such as sulfur, lead, or calcium, to improve its machinability (see http://global.kyocera.com/prdct/tool/faq/index.html or http://www.sumitomometals.co.jp/e/news/news200-02-25.html). Karlsson used a free cutting steel cup housing a free cutting steel polepiece, a primary coil, and a radially charged magnet atop the primary coil and defining the magnetic air gap. Karlsson also used a perforated cap of free cutting steel which partially closes the magnetic circuit. Curiously, Karlsson placed his diaphragm inside the magnetic circuit, beneath the perforated cap (hence the perforations, to allow sound to escape).

More recently, Sony Corp. has been developing induction motor speakers. U.S. Pat. No. 5,062,140 to Inanaga et al. teaches an induction motor loudspeaker in which "the diaphragm is formed into a dome shape and comprises: a vibrating portion which is thinly formed into a semi-spherical shape; and a secondary coil constituted by a conductive portion which is thickly annularly formed at an opening edge portion. The whole diaphragm is a good conductor constructed of metal . . . " Inanaga's induction motor uses an external magnet geometry, with a poleplate (or "T-yoke"), an axially charged ring magnet, and an annular top plate atop the magnet. Inanaga's primary coil is disposed at an inner diameter of the top plate, and forms the magnetic air gap with the polepiece. His conductive dome diaphragm has a cylindrical lower portion which constitutes the shorted turn secondary coil. Inanaga's innovation is a set of techniques for limiting induction of current in the domed remainder of the diaphragm to restrict the induced current to the shorted turn.

U.S. Pat. No. 6,359,996 to Ohashi, also assigned to Sony, teaches a variety of induction motor loudspeaker configurations. Some have internal magnet geometries, and some have external magnet geometries. In each configuration, the primary coil is disposed within the magnetic air gap, either on the inner surface of the magnetic air gap, or on both the inner and outer surfaces of the magnetic air gap and connected in series. Ohashi's innovation was to wind the primary coil(s) on its(their) own bobbin-like cylinder and to provide a step or groove in the back plate for positively positioning the cylinder (s) and primary coil(s), rather than e.g. winding the primary coil(s) directly on the top plate, cup, or polepiece.

In all those prior art induction motors, the induction motor drives the primary (and only) diaphragm; a non-moving primary coil drives a moving shorted turn which is rigidly coupled to or integral with the single diaphragm.

A few other inventors have developed coaxial, dual-diaphragm loudspeakers in which the center tweeter is inductively driven by the moving voice coil of the outer woofer.

U.S. Pat. No. 4,965,839 to Elieli teaches a coaxial loudspeaker in which the moving voice coil of the conventional, outer loudspeaker serves as a primary coil inductively driving a cylindrical skirt of a metallic tweeter dome. Elieli's innovation was to add a phase plug which appears to turn the inductively driven center tweeter into a compression driver.

U.S. Pat. No. 5,742,696 to Walton has teachings similar to Elieli's.

U.S. Pat. No. 6,542,617 to Fujihira et al., also assigned to Sony, is a curious example of a coaxial induction motor loudspeaker, in that there is only a single diaphragm which is coaxially driven. In low frequencies, the diaphragm is driven by a conventional moving voice coil motor. But in high frequencies, the diaphragm is driven by the electrically conductive bobbin which functions as a shorted turn. In the high frequencies, the moving voice coil mechanically separates from the bobbin by softening, liquefaction, or other such lowering of the bonding strength of the bonding agent used to affix the voice coil to the bobbin. The bonding agent functions, in essence, as a high pass filter, enabling the moving voice coil to act as a primary coil.

ATC Loudspeaker Technology Ltd of Gloucestershire, England, offers a line of loudspeakers whose drivers use a conventional moving voice coil motor. ATC's website offers a white paper (http://www.atc.gb.net/technology/Super_Linear_Technical.zip) discussing various benefits obtained by the addition of "Super Linear Magnetic Material" (S.L.M.M.) rings "which replace the steel regions concentric with the voice coil. ATC does not identify this material, but indicates that it offers high magnetic permeability and saturation level and low electrical conductivity. ATC indicates that the presence of these rings "increases the self-inductance of the voice coil. When eddy currents are allowed to circulate in the system, the oppose the magnetic field producing them (i.e. that from the coil) and 'cancel out' much of the self-inductance."

An unnamed author writing for the audio recording magazine Sound On Sound alleges (http://www.soundonsound-.com/sos/1997_articles/oct97/atcscm20a.html) alleges that these rings are "made from pressure-formed powdered iron to form part of the driver pole-piece. Using these rings to form the inner and outer surfaces of the magnetic air gap greatly reduces eddy currents in the pole pieces, producing a dramatic drop in the level of third-harmonic distortion—a problem that's plagued speaker designers ever since someone first had the bright idea of gluing a coil of wire onto the back of a cardboard cone."

One significant drawback that has prevented induction motors from being more commonly used in electromagnetic transducers is that their steel structures, whose main function is to provide a low reluctance path for steering the magnetic flux to and from the magnetic air gap, are also electrically conductive. The oscillating magnetic fields which induce a desired alternating current in the shorted turn, and indeed the oscillating magnetic field generated by the alternating current in the shorted turn itself, also induce unwanted alternating "eddy currents" in any nearby, electrically-conductive parts. These induced currents have several significant, undesirable effects: they cause heating of those parts, they cause flux modulation, and they rob power that could otherwise be put to use driving the diaphragm.

What is needed, then, is an improved induction motor in which the susceptibility to unwanted, induced currents is reduced, minimized, or even eliminated. It appears that, until the present invention, the industry has not understood that improvements in the materials themselves of the magnetic circuit's steel components might be a way to make such improvements.

BRIEF DESCRIPTION OF THE DRAWINGS

FIG. 16 shows a perspective view of a radially vented embodiment of a motor.

FIG. 17 shows a cross-section view of the motor of FIG. 16.

DETAILED DESCRIPTION

The invention will be understood more fully from the detailed description given below and from the accompanying drawings of embodiments of the invention which, however, should not be taken to limit the invention to the specific embodiments described, but are for explanation and understanding only.

Figure 1:
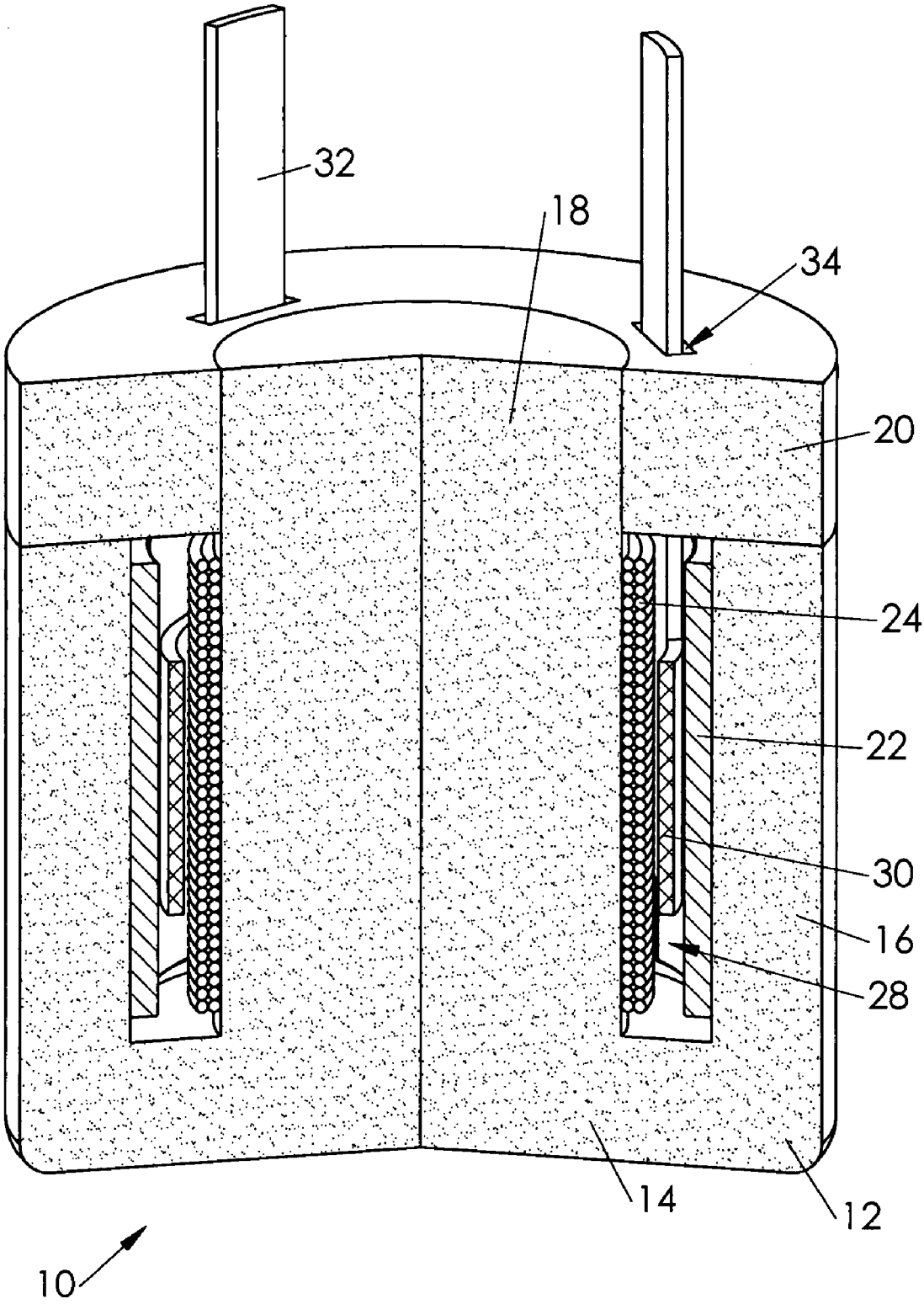
FIG. 1 shows a cross-section view of one embodiment of an induction motor according to this invention.

FIG. 1 illustrates one embodiment of an induction motor 10 according to this invention. The induction motor includes a magnetically conductive cup 12 having a back plate portion 14, an outer cylinder portion 16, and a polepiece portion 18. The back plate, outer cylinder, and polepiece may be of monolithic construction as shown, or they may be distinct components coupled together. The induction motor further includes a radially charged magnet 22 disposed within the outer cylinder; in the example shown, the radially charged magnet is disposed against and magnetically coupled to the inner surface of the outer cylinder, but in other embodiments, it could be disposed against and magnetically coupled to the outer surface of the polepiece.

The induction motor optionally but advantageously includes a magnetically conductive cap 20 which is disposed against and magnetically couples the upper end of the polepiece and the upper end of the outer cylinder. In the embodiment shown, the cap engages the upper surface of the outer cylinder and the outer surface of the polepiece; in other embodiments, it could engage the inner surface of the outer cylinder and/or the upper surface of the polepiece, instead.

The induction motor further includes a fixed, non-moving primary coil 24 which is disposed within the magnetic air gap 28 between the magnet and the polepiece (or between the magnet and the outer cylinder, if the magnet is adjacent the polepiece). The primary coil is driven by an alternating current voice signal applied to ends (not shown) of the primary coil which exit the motor structure e.g. via a hole (not shown) through the back plate, the cap, or other suitable location. In the embodiment shown, the magnetic air gap is formed by the entire height of the radially charged magnet. In other embodiments, a focusing ring (not shown) could be disposed on the magnetic air gap side of the magnet, to concentrate the magnetic flux into a shorter magnetic air gap.

In a different embodiment, the positions of the magnet and the primary coil could be reversed.

The induction motor includes a shorted turn moving coil 30 disposed within the magnetic air gap. The shorted turn can be fashioned of any suitable, electrically conductive material. In one embodiment, it is simply an aluminum ring. The shorted turn is connected to, or integrally formed with, two or more (and preferably three or more) legs 32 which exit the motor structure via holes 34 through the cap. Depending upon the specific geometry of a particular induction motor, the holes may comprise e.g. aligned slots at the mating surfaces of the polepiece, cap, and/or outer cylinder.

In a similar induction motor fashioned of conventional materials, the oscillating magnetic field caused by the alternating current in the primary coil would induce alternating electric current not only in the shorted turn, but also in all other adjacent, electrically conductive structures. Particularly, it will induce current in the polepiece, outer cylinder, back plate, and/or cap, which are conventionally made of some type of steel which has been stamped, forged, or machined into the desired shape.

In the induction motor of the present invention, however, the polepiece, back plate, outer cylinder, and/or cap—and preferably all of those—are formed of a material which is magnetically conductive but not meaningfully electrically conductive. In one embodiment, they are formed of small particles of magnetically conductive material which is held together by epoxy or other suitable binder (hence, rather than being cross-hatched, those components are stippled in FIG. 1 to suggest their composition of a large number of very small particles). In some embodiments, the material is sintered. In other embodiments, the particles are coated with an electrically insulating material which, when pressed or heated, binds adjacent particles together In one embodiment, the small particles comprise powdered metal such as powdered iron. Powdered iron has been used in manufacturing toroidal cores, which are employed as components in audio amplifiers, tuned tank circuits, bandpass and other filters, Pi network inductors, and the like. (See http://www.electronics-tutorials.com/basics/toroids.htm.) Powdered iron has also been used in manufacturing E cores and other cores for switched mode power supplies. (See http://en.wikipedia.org/wiki/Powdered_core or http://en.wikipedia.org/wiki/Magnetic_core.) One form of powdered iron is carbonyl iron, which is composed of spherical microparticles of highly pure iron, prepared by chemical decomposition of purified iron pentacarbonyl. (See http://en.wikipedia.org/wiki/Carbonyl_iron.) One source of powdered iron is Micro-Metals Inc., of Anaheim, Calif.

Figure 2:
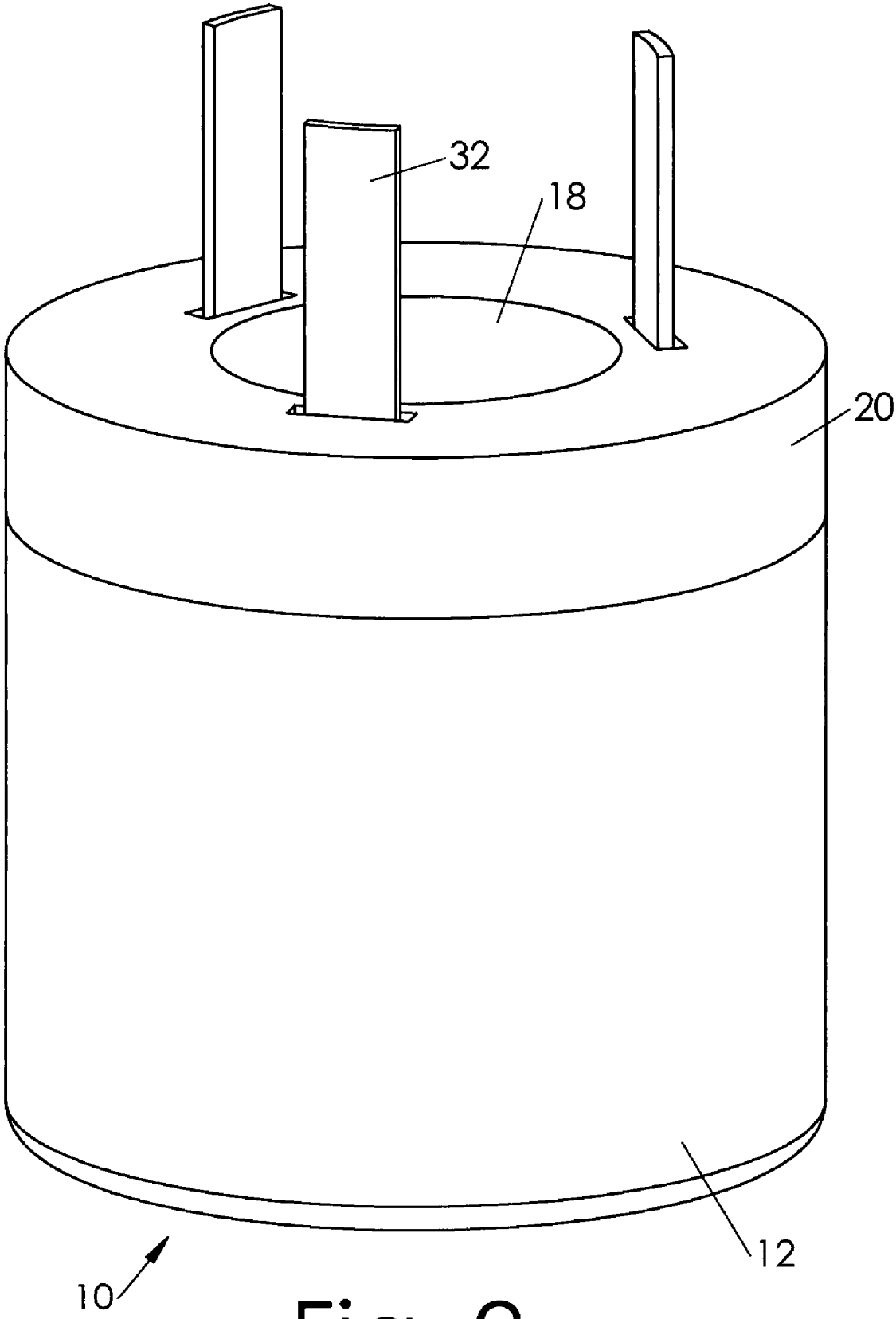
FIG. 2 shows a perspective view of the motor of FIG. 1.

FIG. 2 illustrates the induction motor 10 in perspective view, showing the cup 12, cap 20, pole piece 18, and legs 32 attached to the shorted turn (not visible).

Figure 3:
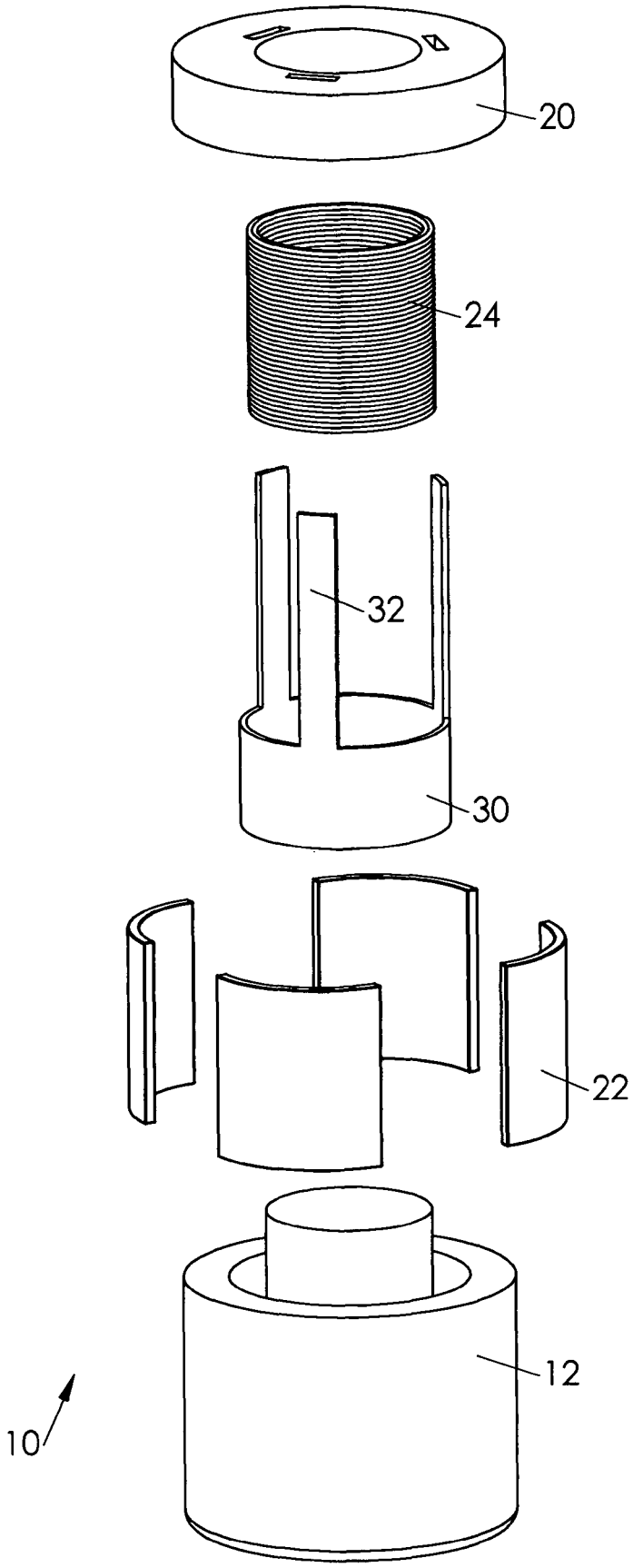
FIG. 3 shows an exploded view of the motor of FIG. 2.

FIG. 3 illustrates the induction motor 10 in an exploded view, including the cup 12, a radially-charged permanent magnet 22 or, preferably, set of magnet segments, shorted turn 30 with its legs 32, primary coil 24, and cap 20.

Figure 4:
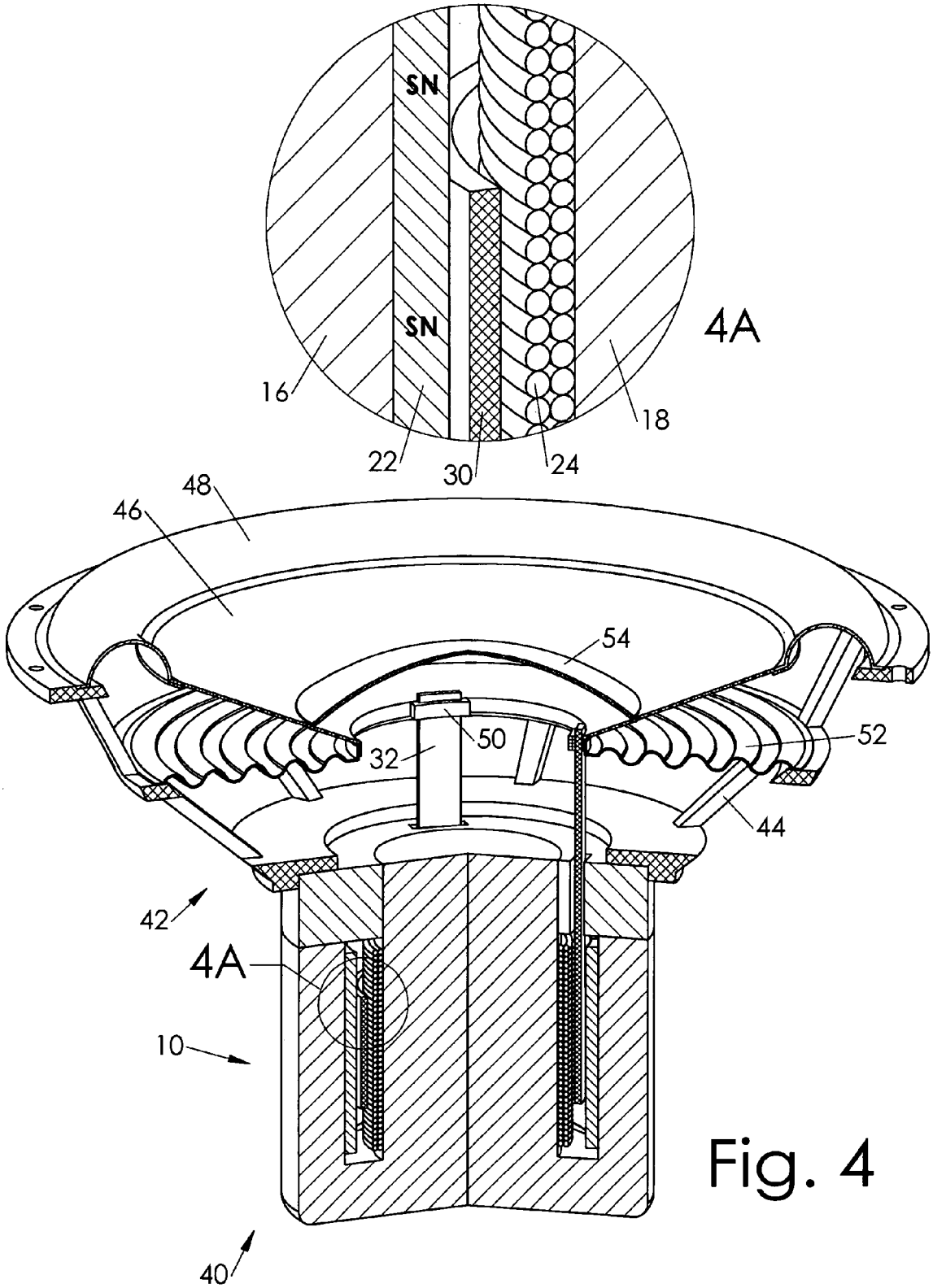
FIG. 4 shows a cross-section view of one embodiment of an electromagnetic loudspeaker utilizing the motor of FIG. 1.

FIG. 4 illustrates an electromagnetic transducer 40 utilizing the induction motor 10. In one embodiment, the electromagnetic transducer is a loudspeaker, and specifically a subwoofer. The loudspeaker includes a diaphragm assembly 42 coupled to the induction motor 10 by a frame 44. The diaphragm assembly includes a diaphragm 46 coupled to the frame by a surround 48. The diaphragm is coupled to the legs 32 of the shorted turn assembly to be driven by the shorted turn. In one embodiment, the diaphragm includes slotted fixtures 50 adapted for coupling to the legs by any suitable means (not shown), such as epoxy, screws, crimping, or what have you. The diaphragm and/or the legs are coupled to the frame by a spider 52. A dust cap 54 seals the front side of the diaphragm from the back side, and facilitates loudspeaker assembly.

In FIG. 4, the magnetically conductive components are cross-hatched to best show their identities and extents, whereas in FIG. 1 they were stippled to suggest their composition.

Figure 5:
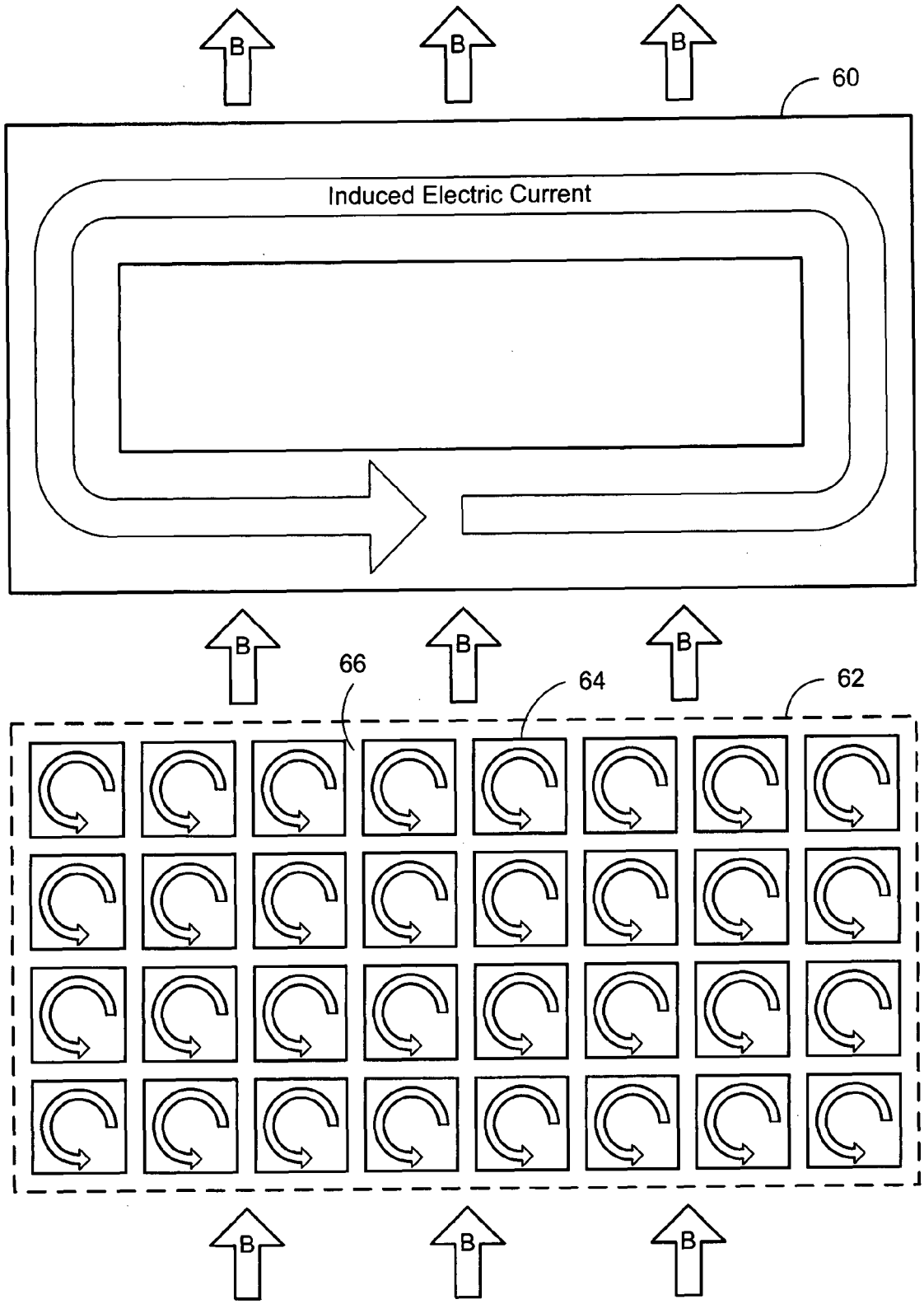
FIG. 5 is a stylized illustration of how the improved induction motor of this invention prevents the induction of unwanted, gross-scale eddy currents.

FIG. 5 illustrates what is intended by the phrase "gross-scale", as in "gross-scale induced current". In the presence of a magnetic field, indicated by the arrows labeled "B", a large, electrically conductive member 60, such as a block of aluminum, will have induced in it a significant electric current. This electric current is free to flow throughout the block as a whole. It is "gross-scale" with respect to the block, as it flows substantially throughout and around the entire block.

By way of contrast, a structure 62 which is substantially the same size as the block, but which is made up of a large number of much smaller electrically conductive members 64 which are electrically insulated from each other by space or by some resistive material 66 in the spaces between the smaller members, will not have any gross-scale electric current induced in it. Each of the smaller members may have a "small-scale" or "fine-scale" electric current induced within it. But because the smaller members are insulated from each other, these many fine-scale currents are not able to join into a gross-scale current, and there is no current which flows throughout and around entire structure as a whole.

Figure 6:
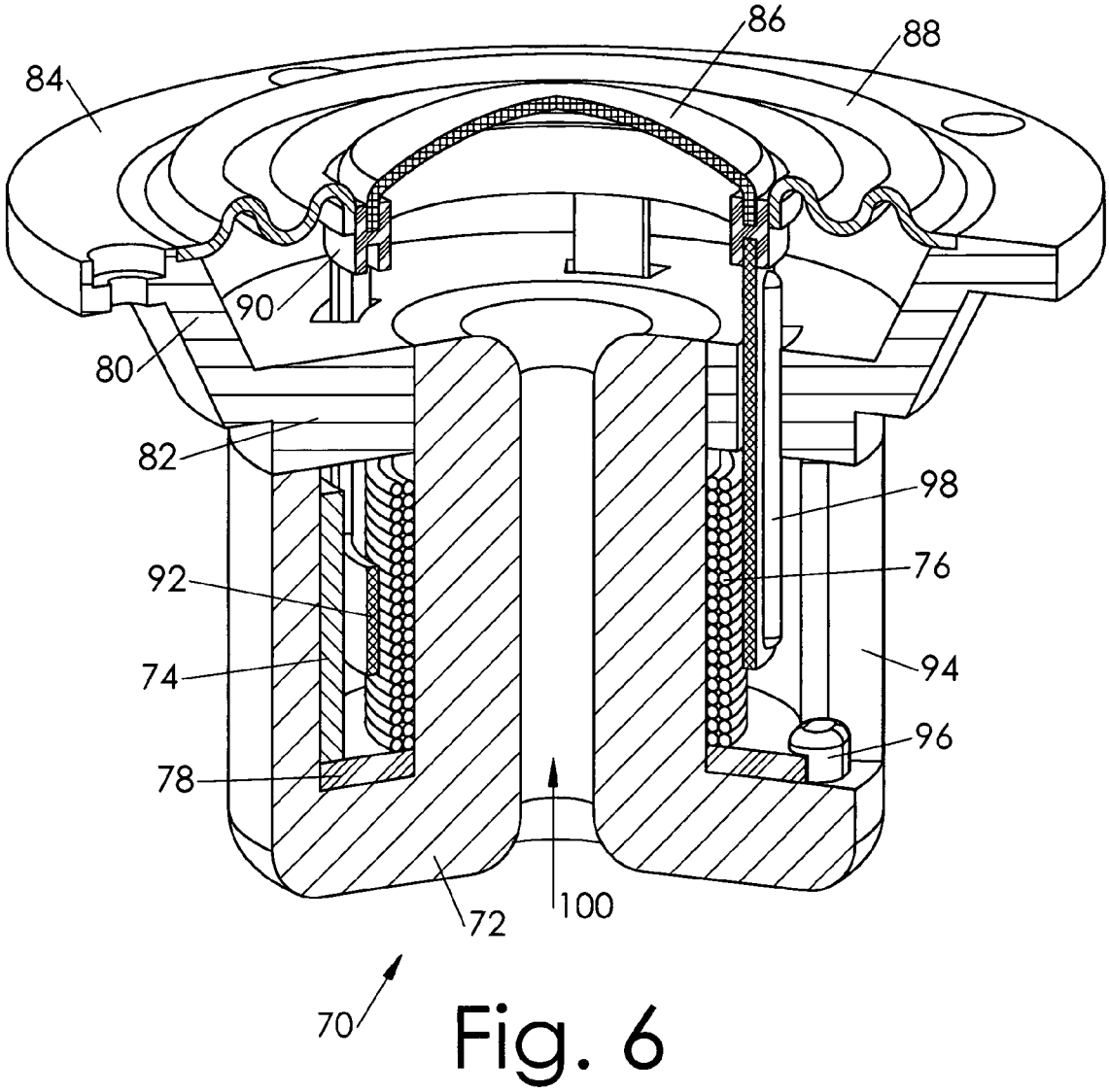
FIG. 6 shows a tweeter having an induction motor according to this invention.

FIG. 6 illustrates a high frequency dome transducer 70 (such as a tweeter, or which can be used in constructing a horn driver or a compression driver) using an induction motor constructed according to the principles of this invention. The induction motor includes a cup 72 containing a plurality of radially charged magnet segments 74 and a primary coil 76. Optionally, the magnets and primary coil are displaced away from the back plate of the cup by a spacer 78 made of e.g. plastic. The cup is formed of powdered iron held together by a suitable binder material. A frame 80 is coupled to the motor. Optionally, the frame is also formed of powdered iron held together by a suitable binder material, and a lower portion of the frame forms a cap 82 which improves the magnetic sealing and overall magnetic permeability of the motor. An outer flange 84 of the frame is adapted for coupling the tweeter to a suitable enclosure or baffle, or to a woofer to form a coaxial two-way speaker.

A diaphragm 86 is coupled to the frame by a suspension component 88 such as a surround. An attachment ring 90 is coupled to the diaphragm. The motor includes a shorted turn secondary coil 92 which, in embodiments having a cap 82, is adapted with legs which protrude through the cap. The legs are coupled to the attachment ring.

In some embodiments, the cup and frame form a self-sealing enclosure for the back side of the diaphragm. In other embodiments, the cup and/or frame are ventilated to improve air flow cooling of the motor and/or to alter the enclosed air volume against which the diaphragm is operating. In one such embodiment, the cup includes a plurality of slots 94, which may advantageously be aligned with spaces between the magnet segments. The spacer may optionally be fitted with clocking lugs 96, each of which is positioned in a respective motor slot and between a respective adjacent pair of magnets, preventing the magnets from becoming misaligned and obstructing the slot (which would reduce air flow and, more importantly, reduce effectiveness of the magnetic circuit as the misaligned magnet surface area would not be in direct contact with the cup).

The portions of the cap directly above these slots do not contribute to the magnetic circuit as much as other portions of the cap, and therefore the holes through the cup can be increased in size radially without unduly impacting the motor's effectiveness. Without tight tolerances required in those regions, the legs of the shorted turn can be stiffened by the addition of radially-extending members 98 which have the effect of giving the legs an I-beam or T-beam or C-beam configuration, significantly increasing their lateral stiffness and reducing their tendency to deflect, in turn reducing the likelihood of the shorted turn striking or rubbing on the primary coil or the magnets.

The center pole of the cup can be ventilated with an axial bore 100 as shown, if there is sufficient remaining material to avoid magnetic saturation if that is desired.

The shorted turn has been shown as being underhung with respect to the magnetic air gap defined by the magnets and the primary coil. In other embodiments, the shorted turn could be overhung, equalhung, or otherwise hung. For example, the motor could use the multiple magnetic air gap technique taught in U.S. Pat. No. 6,917,690 "Electromagnetic Transducer Having Multiple Magnetic Air Gaps Whose Magnetic Flux is in a Same Direction" by Stiles or U.S. Pat. No. 6,996,247 "Push-Push Multiple Magnetic Air Gap Transducer" by Stiles.

Figure 7:
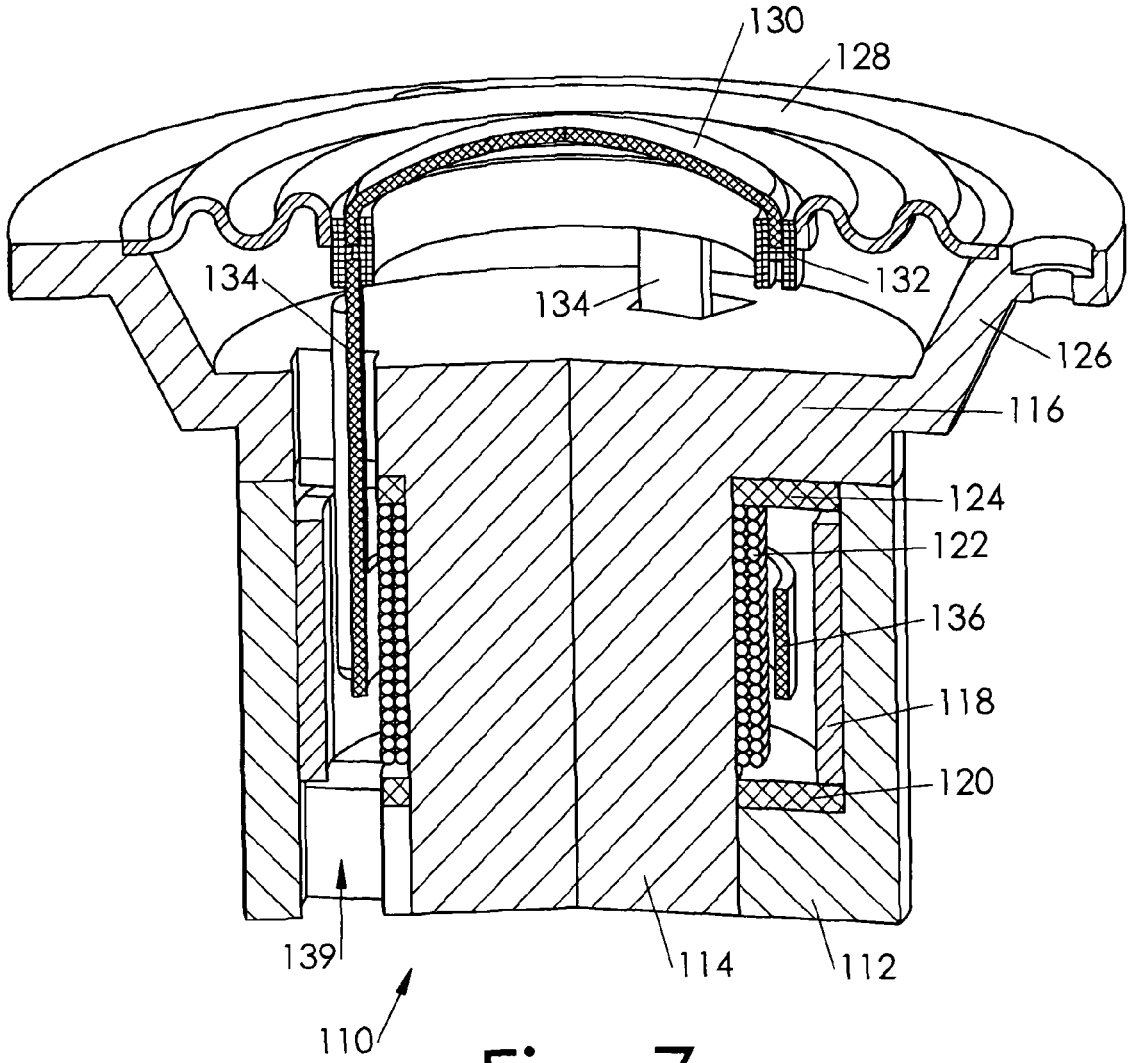
FIG. 7 shows another embodiment of an induction motor loudspeaker according to this invention.

FIG. 7 illustrates a loudspeaker 110 according to another embodiment of this invention. The loudspeaker includes a cup 112, a center pole 114, and a cap 116, at least one of which is formed of powdered iron. In embodiments described above, the center pole was formed as an integral part of the cup. But in the present embodiment, the center pole is a separate component from the cup. Optionally, the center pole and the cap are of integral construction, as shown, but they may also be separate components.

The cup is fitted with one or more radially charged magnets 118 which are optionally held away from the back plate portion of the cup by a non-magnetic spacer 120. A primary coil 122 is wound onto the center pole. The center pole is optionally equipped with a non-magnetic spacer 124 which holds the primary coil away from the cap.

A frame 126 is coupled to or, as shown, integrally formed with the cap, and provides support for a surround 128. A dome diaphragm 130 is coupled to the surround either directly or, as shown, by a support ring 132. The support ring couples the diaphragm to legs 134 of a shorted turn 136.

Figure 8:
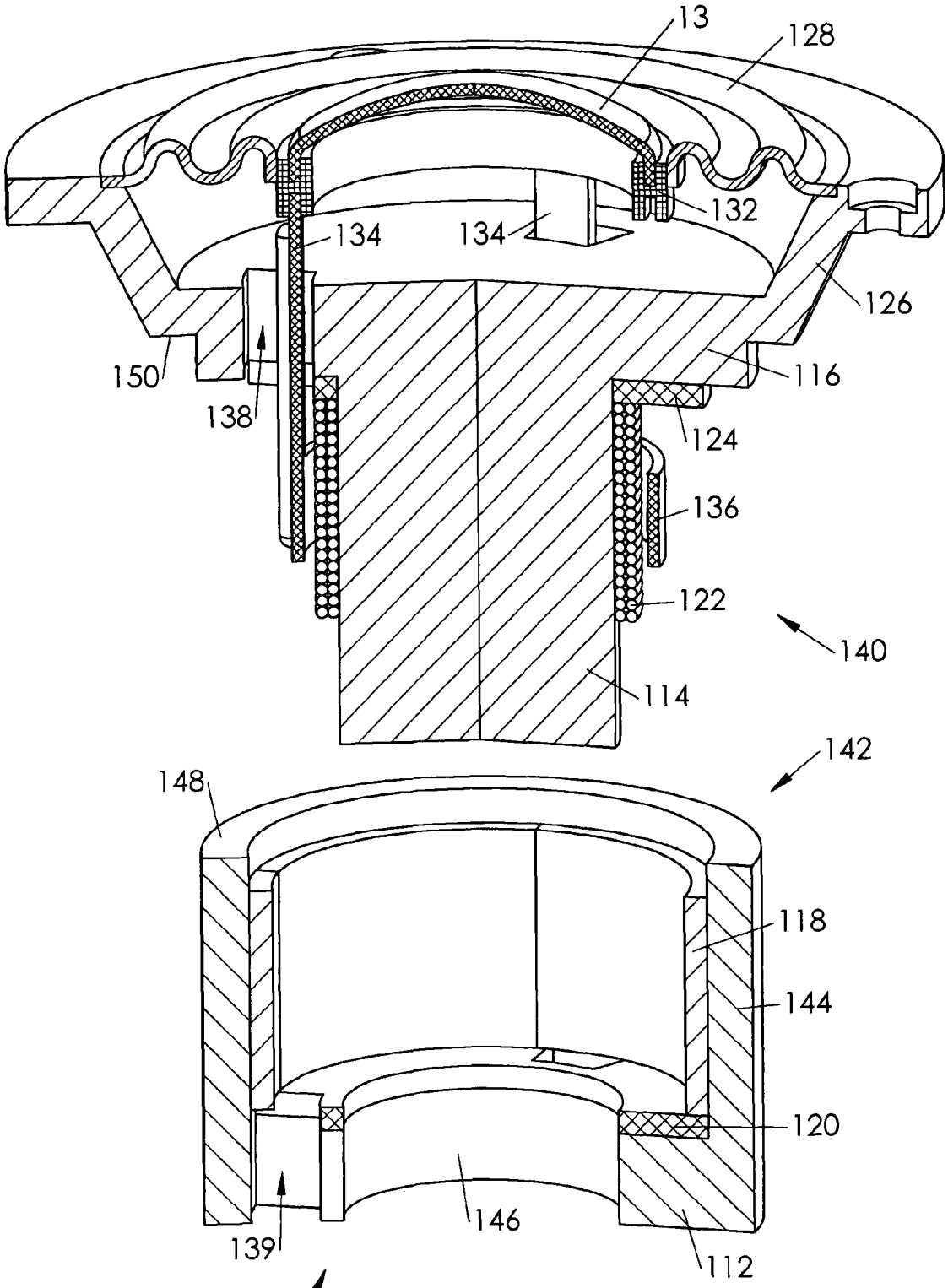
FIG. 8 shows a partially assembled view of the loudspeaker of FIG. 7.

FIG. 8 illustrates a latter stage of assembly of the loudspeaker 110, whereas FIG. 7 showed it fully assembled. Initially, the spacer 124 is fastened in place on the cap or center pole, and the primary coil 122 is wound onto the center pole. Then the legs 134 of the shorted turn 136 are inserted up through holes 138 in the cap 116. Then the support ring 132 is coupled to the legs. The dome diaphragm 130 is coupled to the support ring either before or after this operation, and in fact may be integrally formed with it. The surround 128 is coupled to the support ring either before or after that operation, and is now coupled to the frame 126. The upper assembly 140 of the loudspeaker is now complete.

The lower assembly 142 may be assembled either prior to, during, or after the upper assembly. The spacer 120 is inserted into the cup 112 against its back plate portion. The radially charged magnet segments 118 are coupled inside the cylinder portion 144 of the cup.

Then the lower assembly can simply be mated with the upper assembly. An inner mating surface 146 of the cup's back plate mates with the outer surface of the center pole, and an upper mating surface 148 of the cup's cylinder portion butts against a mating surface 150 of the cup or frame.

During operation of the loudspeaker, the primary coil and shorted turn are cooled by airflow through optional vent holes 139 through the bottom of the cup. Because these vent holes are not through a portion of the magnetic circuit which forms the magnetic air gap, they will not reduce the BL of the motor, as long as the surrounding material is thick enough to avoid magnetic saturation.

Figure 9:
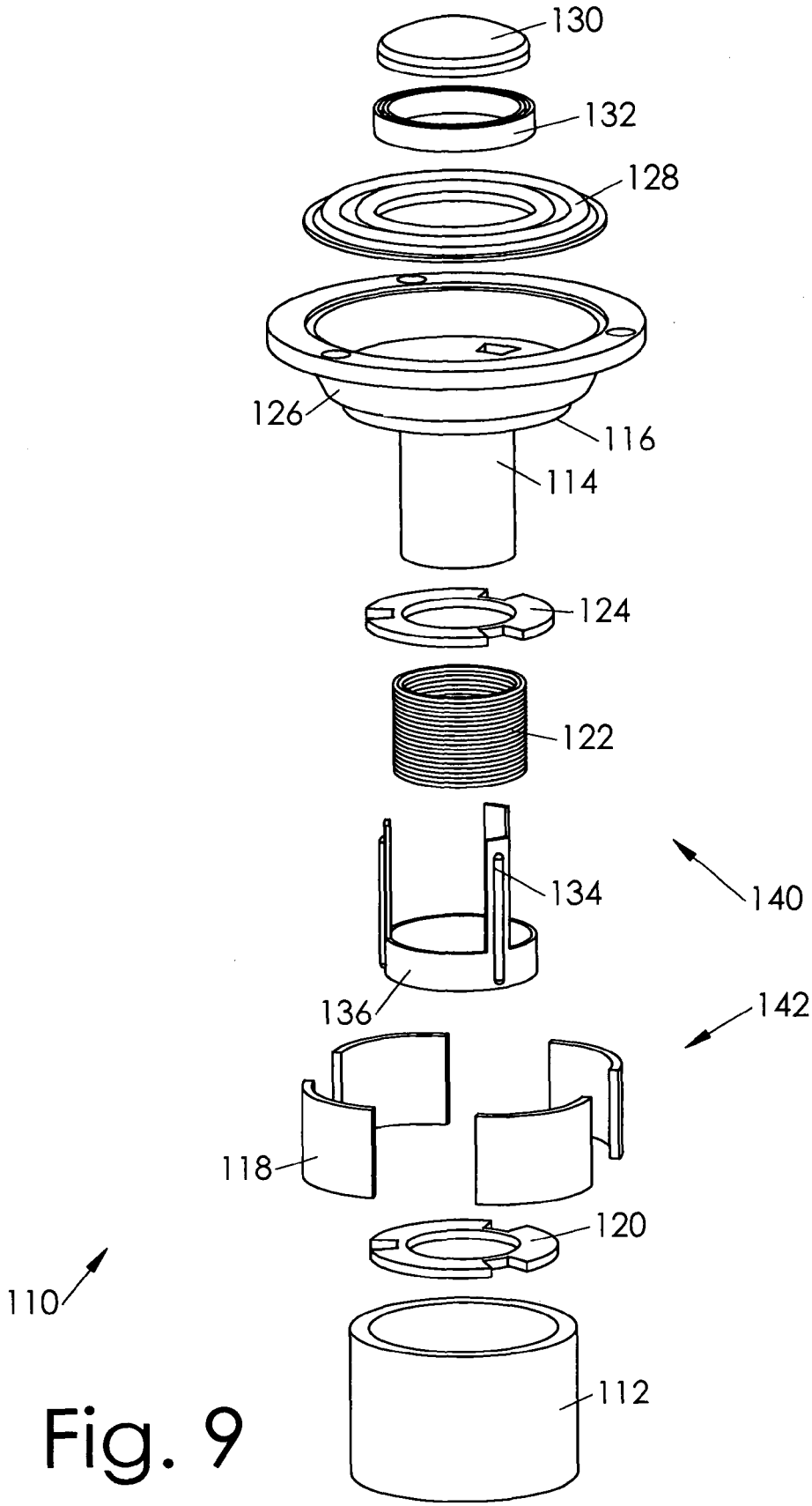
FIG. 9 shows an exploded view of the loudspeaker of FIG. 7.

FIG. 9 illustrates the loudspeaker 110 of FIGS. 7 and 8 in an exploded view.

Figure 10:
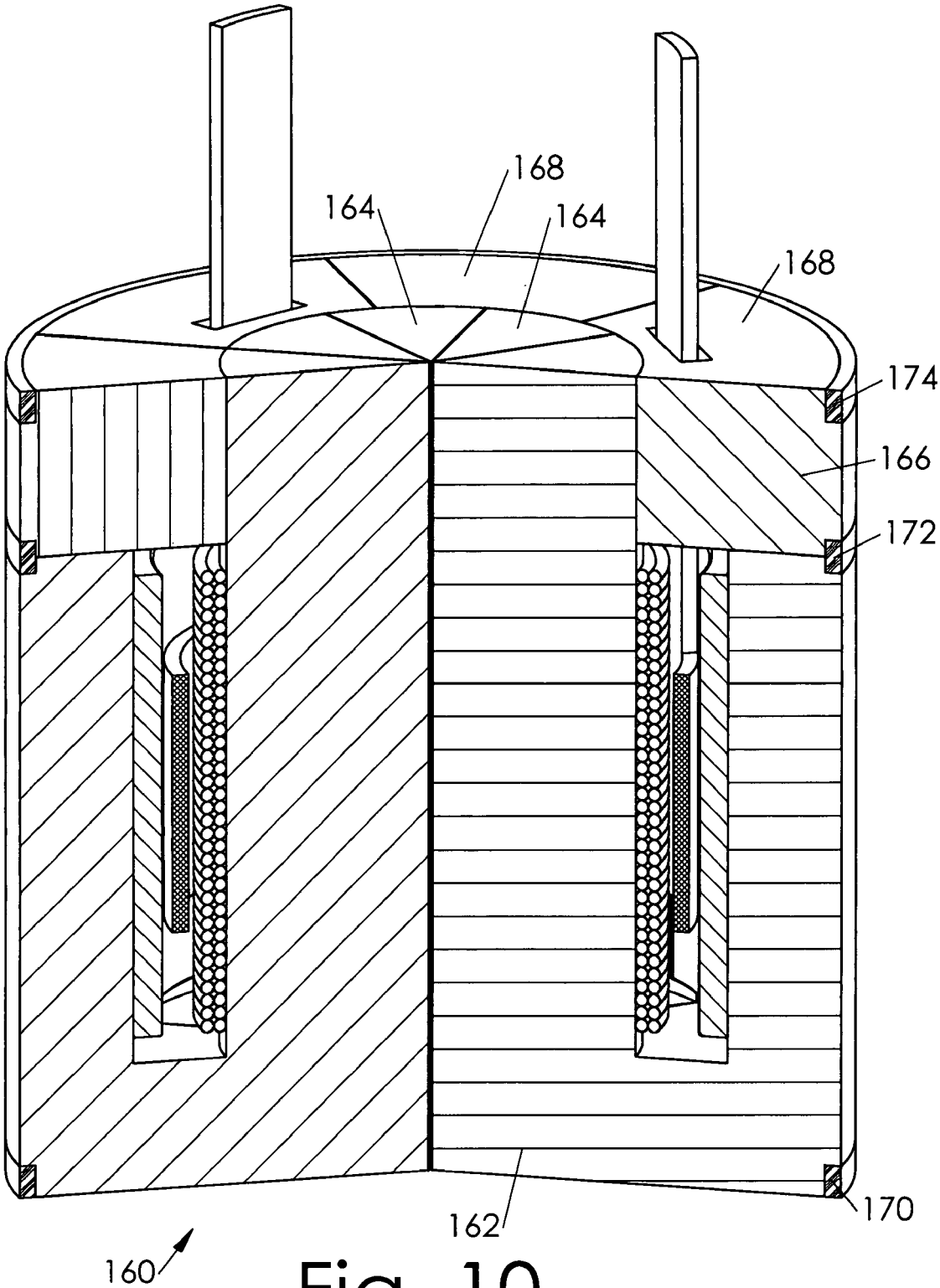
FIG. 10 shows a cross-section view of an induction motor for a loudspeaker using transformer style lamination rather than powdered iron.

FIG. 10 illustrates an induction motor 160 for a loudspeaker, according to another embodiment of this invention. Whereas the cup, center pole, and/or cap of previously described embodiments were formed of e.g. powdered iron, in this embodiment they are formed of conventional steel but in segmented, insulated sections rather like the construction of a transformer. The insulation breaks the segmented components into smaller pieces, in order to prevent gross scale electrical currents from being induced in the overall structure.

The motor includes a cup 162 which is formed of a plurality of wedge-shaped segments 164 which are electrically insulated from each other by thin layers of insulating material (not labeled, but visible where the segments meet). The motor includes a cap 166 which is formed of a plurality of wedge-shaped segments 168 which are electrically insulated from each other by thin layers of insulating material. The cup and cap are optionally insulated from each other. The cup and cap may be formed of the same number of wedge segments, or of different numbers of wedge segments. The cap includes holes through which the legs of the shorted turn extend; these may be formed through only a subset of the wedge segments, as shown, or through all of the wedge segments.

The wedge segments of the cup, and the wedge segments of the cap, are held together by any suitable means. In one embodiment, they are simply glued together. In the embodiment shown, they are mechanically coupled together by a set of rings 170, 172, 174.

The same wedge segments may form both the cup and the center pole, as shown, or those could be formed by separate wedge segments.

Figure 11:
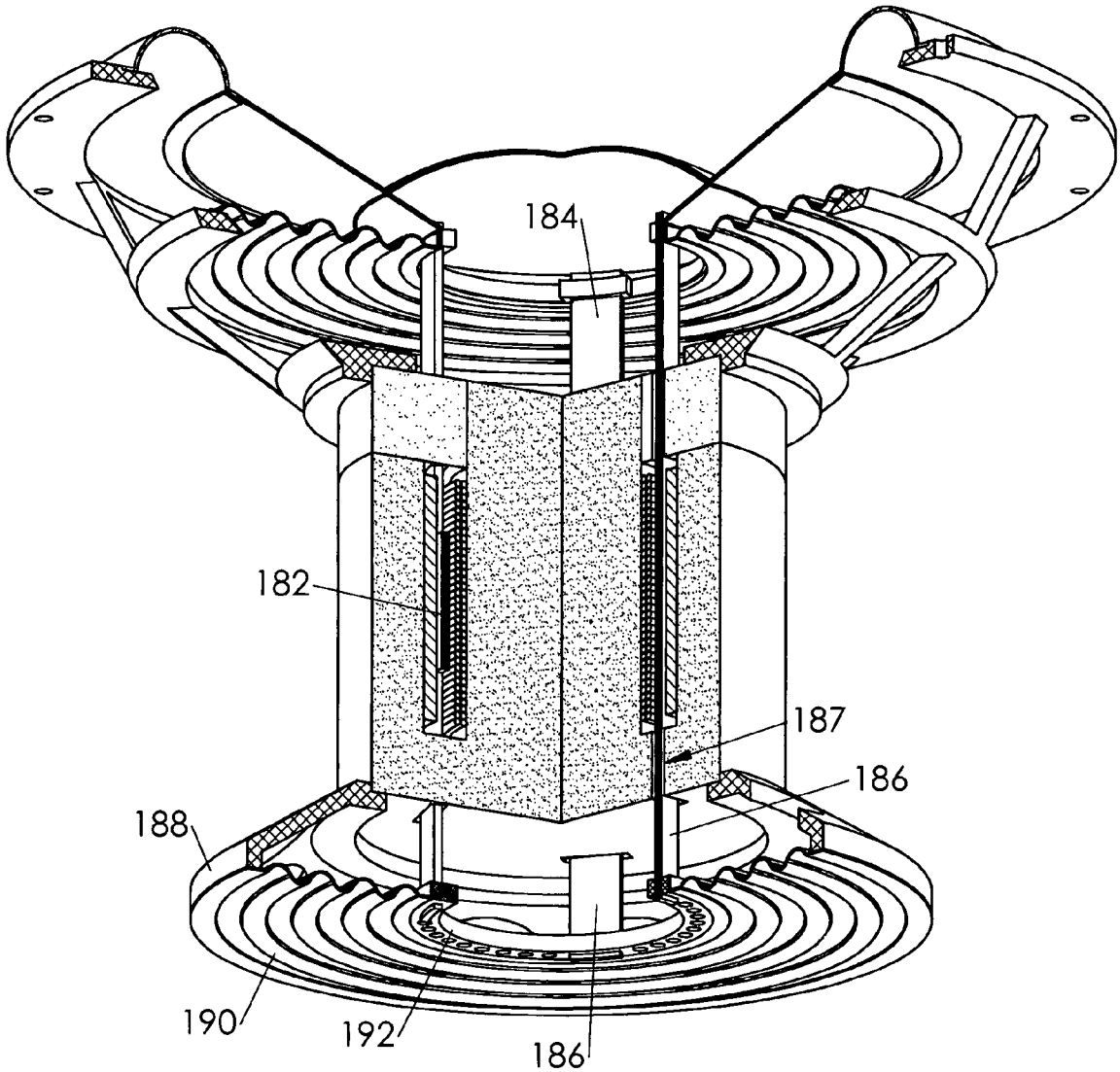
FIG. 11 shows a loudspeaker having an induction motor according to another embodiment of this invention, in which the shorted ring is stabilized by spiders at both ends of the motor.

FIG. 11 illustrates a loudspeaker 180 according yet another embodiment of the invention. The loudspeaker includes an induction motor such as those described above, formed of powdered iron, wedge-shaped insulated steel segments, or the like. As before, the shorted turn 182 includes legs 184 which extend upward through the cap toward the diaphragm assembly. But in this embodiment the shorted turn also includes legs 186 which extend downward through the cup.

A lower frame 188 is coupled to the cup and supports a lower spider 190 which is fastened to the lower legs by a lower support ring 192. In this configuration, the induction motor can be manufactured and assembled with very tight tolerances between the shorted turn and the primary coil, and between the shorted turn and the magnets, because having the shorted turn supported by centering suspension components at both ends, plus the extreme distance between the lower spider and the upper spider (or between the lower spider and the surround), very significantly reduce the ability of the shorted turn to rock or otherwise move radially off center.

Figure 12:
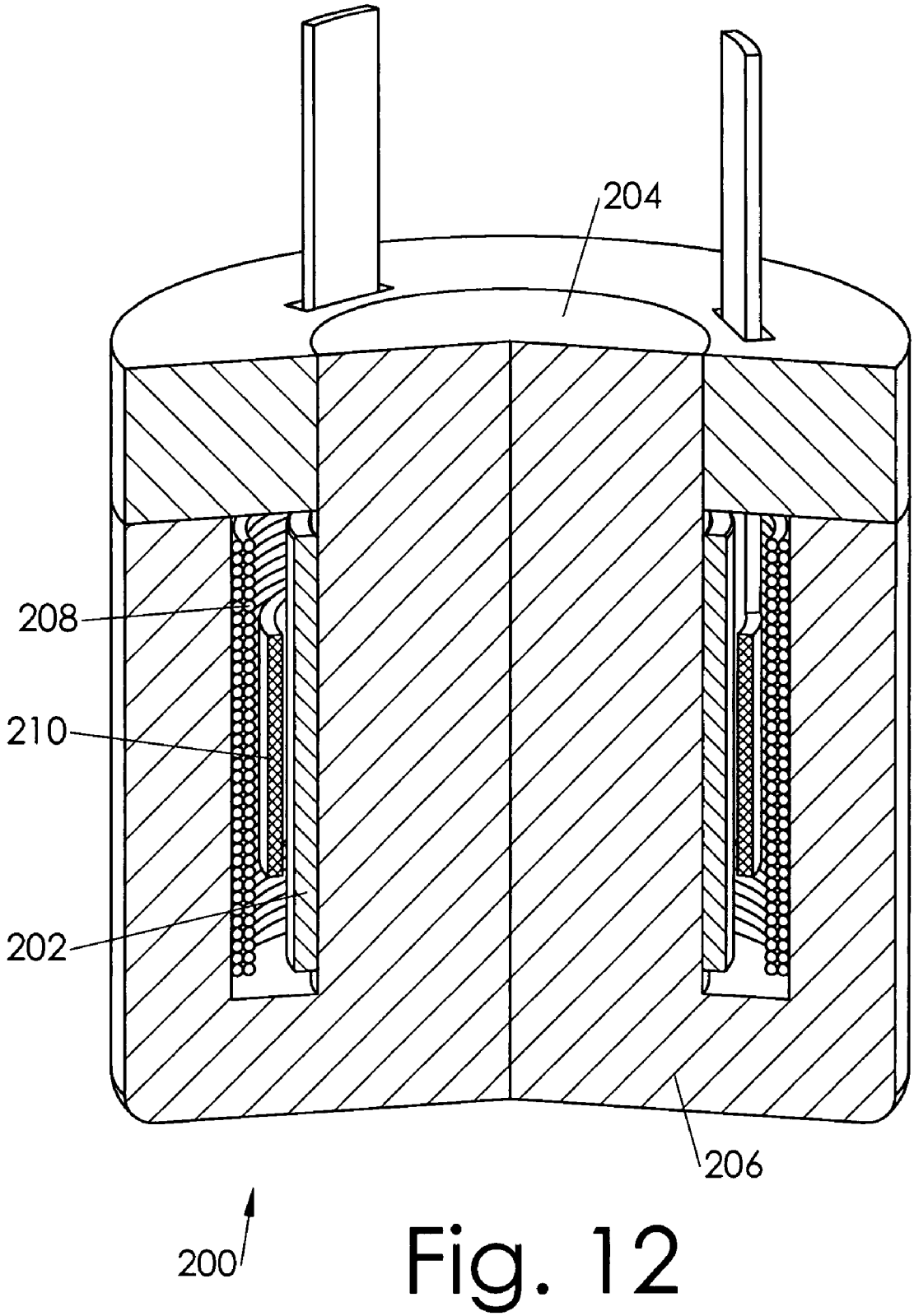
FIG. 12 shows an induction motor in which the magnets are inside the shorted turn and the primary coil is outside the shorted turn.

FIG. 12 illustrates an induction motor 200 similar to that of FIG. 1, except that the radially charged magnet segments 202 are coupled to the center pole 204 of the cup 206, and the primary coil 208 is coupled to the cylinder portion of the cup, such that the magnets are inside the shorted turn 210 and the primary coil is outside the shorted turn.

Figure 13:
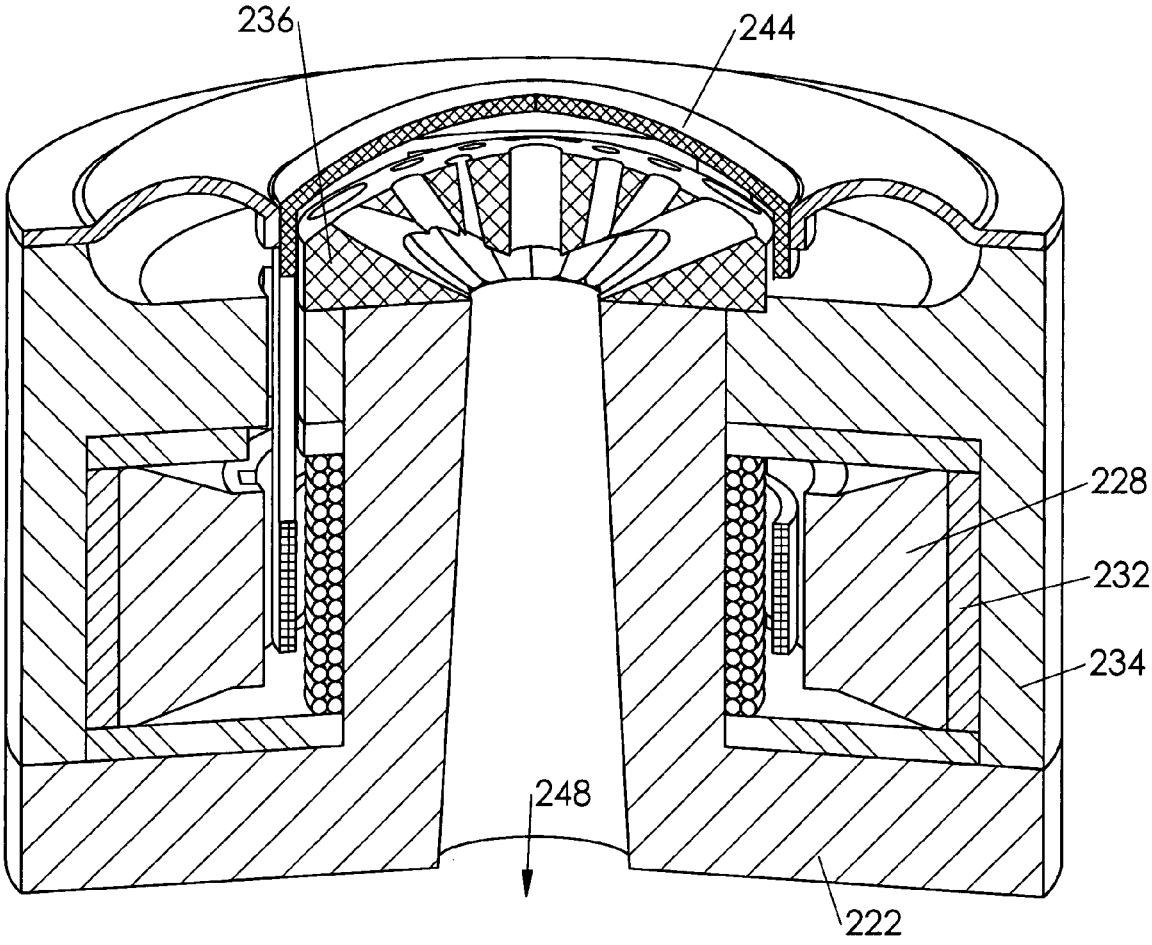
FIG. 13 shows a cross-section view of a compression driver having a motor in which at least one of the soft magnetic components is made of powdered metal.
Figure 14:
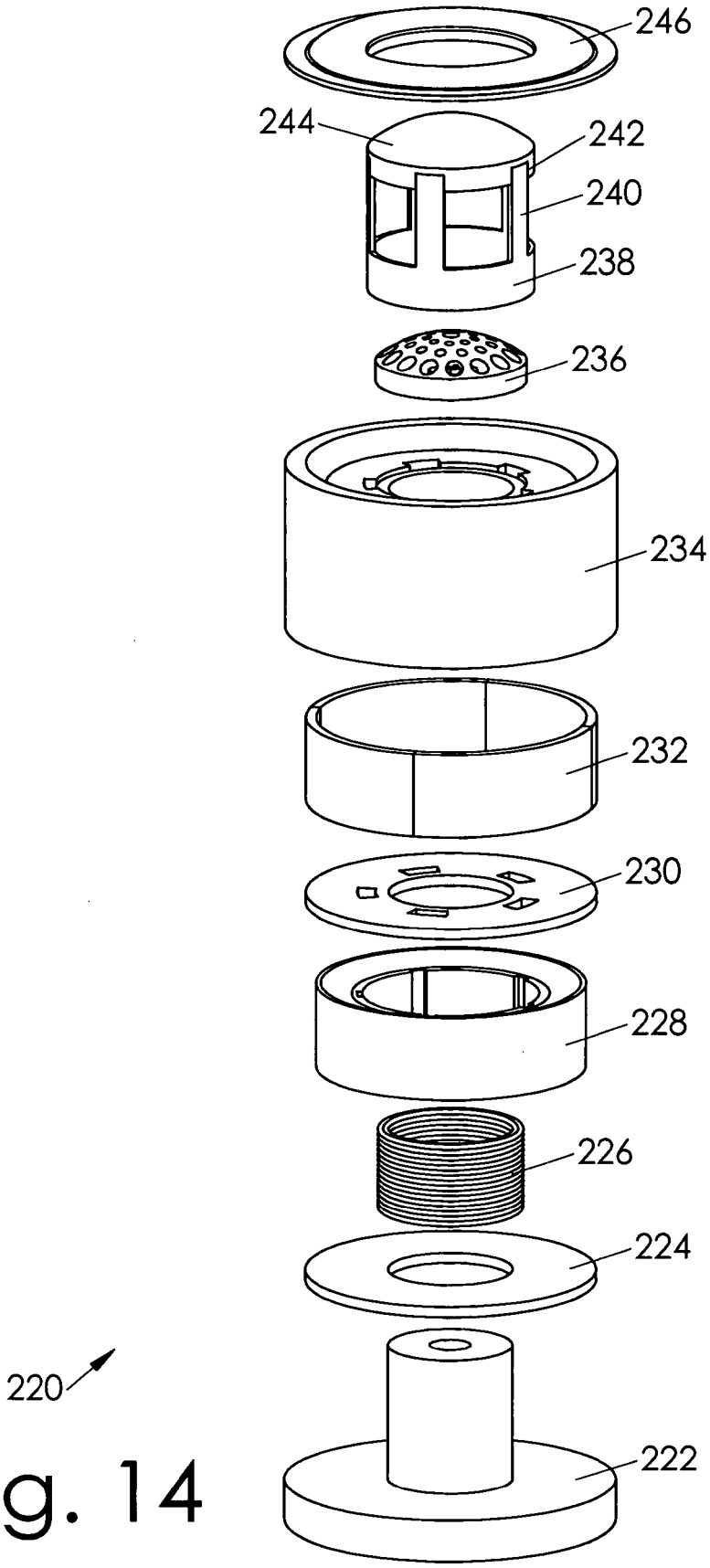
FIG. 14 shows the compression driver of FIG. 13 in an exploded view.

FIGS. 13 and 14 illustrate one embodiment of a compression driver 220 constructed according to the principles of this invention. The compression driver includes a lower T-yoke 222, a lower spacer 224, a primary coil 226, a focusing ring 228, an upper spacer 230, a radially-charged magnet or magnet segments 232, an upper inverted cup yoke 234, a phase plug 236, a diaphragm assembly including a shorted turn 238 having legs 240 which mate with slots 242 in the skirt of a dome diaphragm 244, and a surround 246.

In operation, sound pressure is produced by the underside of the diaphragm which forces air through the porous phase plug into a throat 248 which may optionally be coupled to a wave guide or horn (not shown). The outer (upper) surface of the diaphragm is not exposed to the listening environment, but is typically inside a cabinet.

The focusing ring gathers magnetic flux from the magnet and focuses it radially inward to the magnetic air gap. This enables the use of a significantly larger total magnet surface area than would be available if the magnet were restricted to the diameter of the magnetic air gap. The focusing ring may also concentrate the flux into a smaller axial dimension, as illustrated. This increases the distance (and thus the magnetic reluctance) to the plate portions of the yokes, reducing the amount of stray flux lost from the magnetic air gap.

The T-yoke, inverted cup yoke, focusing ring, and/or phase plug may be fabricated from e.g. powdered iron, such that they are magnetically permeable but electrically resistive.

Figure 15:
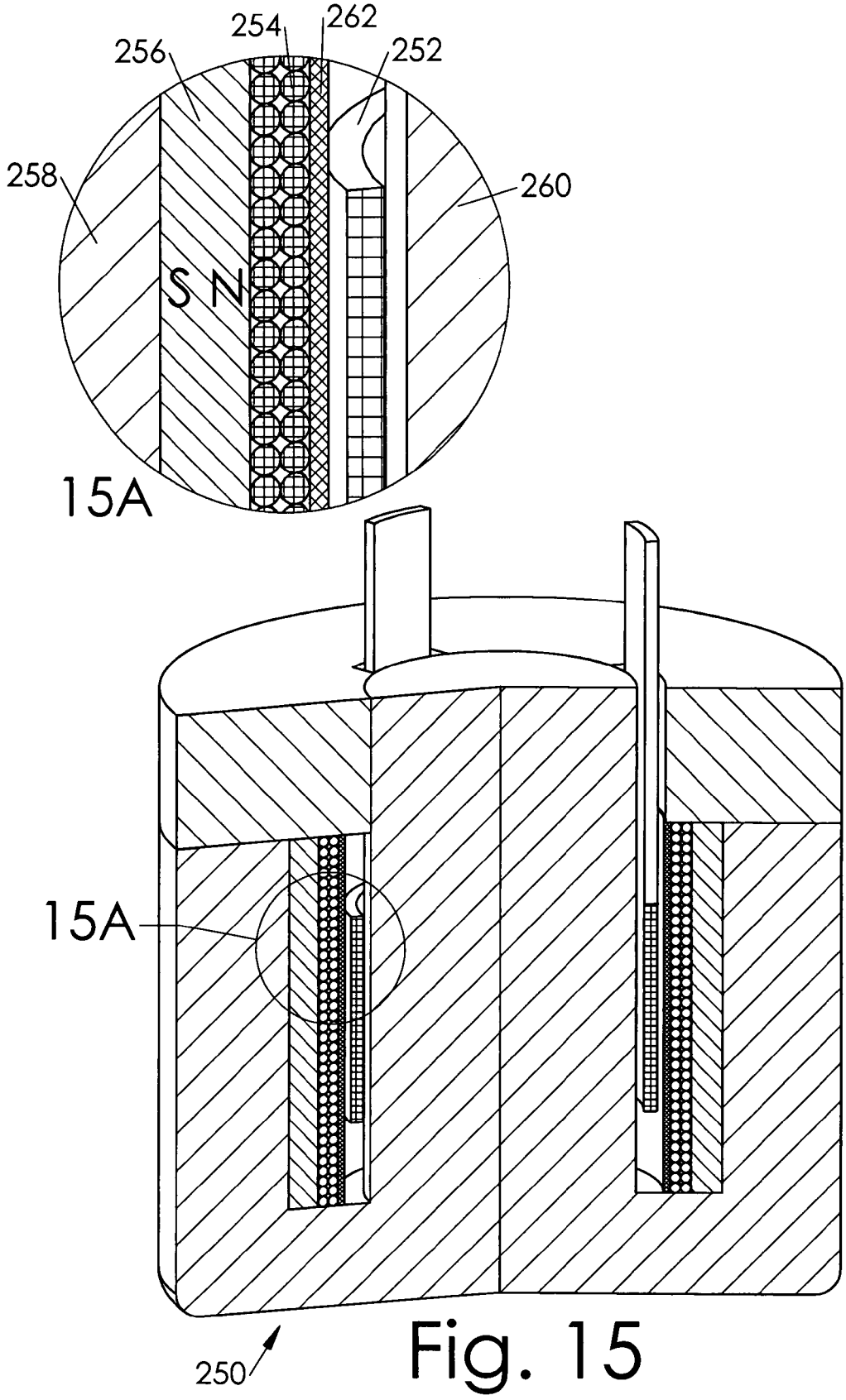
FIG. 15 shows an embodiment in which the shorted turn is not disposed between the magnet and the primary coil.

FIG. 15 with detail view 15A illustrates an electromagnetic transducer motor structure 250 according to yet another embodiment of this invention. In previously described embodiments, the shorted turn was disposed between the primary coil and the radially-charged magnets. However, in this embodiment, the shorted turn 252 is disposed inside both the primary coil 254 and the magnet 256. The magnet is coupled to the inner face of the outer cylinder portion 258 of the cup, and the center pole 260 itself defines the magnetic air gap.

The cup and/or the top plate may be formed of e.g. powdered iron.

Optionally, the primary coil may be wound around a former 262. The former provides support for the primary coil during winding of the coil, and also during operation of the motor. The former also presents a smooth surface which is less likely to be damaged by or to catch the shorted turn. The former does, of course, result in a slight increase in the width of the magnetic air gap.

In another embodiment, the shorted turn could be disposed on the outside of both the primary coil and the magnet, with the outer cylinder forming the magnetic air gap.

FIGS. 16 and 17 illustrate an embodiment of a motor structure 270 which is radially vented. The cup includes one or more sets of radial holes 272, 274 through which air may flow during operation of the motor. The magnet, primary coil, and former are provided with corresponding holes, to avoid obstructing the air flow. The primary coil may in such embodiments comprise two or more distinct coil sections, which may be wired in series or parallel. Optionally, clocking pins (not shown) may be inserted into one or more of the holes to maintain proper alignment of the cup, magnet, primary coil, and former. Optionally, if there are two or more sets of holes through the cup, they may be staggered at different rotational positions as shown in FIG. 16; this may help reduce magnetic reluctance increases caused by the holes. In some applications, the small gaps between the primary coil segments may not materially alter the BL or performance of the motor.

CONCLUSION

When one component is said to be "adjacent" another component, it should not be interpreted to mean that there is absolutely nothing between the two components, only that they are in the order indicated. When one component is said to be "magnetically coupled to" another component, it should be interpreted to mean that the two components are adjacent one another such that they constitute a portion of a magnetic circuit, not necessarily that they are held against each other by magnetic force generated by either of them.

The various features illustrated in the figures may be combined in many ways, and should not be interpreted as though limited to the specific embodiments in which they were explained and shown.

Those skilled in the art, having the benefit of this disclosure, will appreciate that many other variations from the foregoing description and drawings may be made within the scope of the present invention. Indeed, the invention is not limited to the details described above. Rather, it is the following claims including any amendments thereto that define the scope of the invention.

What is claimed is:

1. An electromagnetic transducer comprising:
a diaphragm assembly including,
a diaphragm; and
an induction motor including,
a yoke comprised of a material including a multitude of small, magnetically conductive particles which are electrically insulated from each other,
a permanent magnet,
a stationary primary coil for conducting an alternating current voice signal,
a magnetic air gap, and
a shorted turn coil disposed within the magnetic air gap and mechanically coupled to drive the diaphragm.

2. The electromagnetic transducer of claim 1 wherein the material comprises:
powdered iron.

3. The electromagnetic transducer of claim 2 wherein:
the powdered iron is sintered.

4. The electromagnetic transducer of claim 2 wherein the material further comprises:
a binder impregnated with the powdered iron.

5. The electromagnetic transducer of claim 1 further comprising:
a frame coupled to the induction motor; and
a surround coupling the diaphragm to the frame.

6. The electromagnetic transducer of claim 1 further comprising:
legs coupling the shorted turn coil to the diaphragm.

7. The electromagnetic transducer of claim 1 wherein the induction motor further comprises:
a magnetically conductive cap coupled to the yoke so as to substantially magnetically seal the magnetic air gap.

8. The electromagnetic transducer of claim 7 wherein:
the cap comprises a material including a multitude of small, magnetically conductive particles which are electrically insulated from each other.

9. The electromagnetic transducer of claim 8 wherein:
the cap and the yoke are comprised of a same material.

10. The electromagnetic transducer of claim 7 wherein:
the cap includes a plurality of holes; and
the induction motor further includes a plurality of legs coupling the shorted turn coil to the diaphragm, each leg extending through a respective hole in the cap.

11. The electromagnetic transducer of claim 1 wherein:
the yoke comprises a cup including a back plate portion, a polepiece portion, and an outer cylinder portion;
the permanent magnet comprises at least one radially charged magnet segment disposed against one of an inner surface of the outer cylinder portion and an outer surface of the polepiece portion;
the secondary coil is disposed against the other of the inner surface of the outer cylinder portion and the outer surface of the polepiece portion;
wherein the magnetic air gap is between the permanent magnet and the primary coil.

12. The electromagnetic transducer of claim 11 wherein the induction motor further comprises:
a magnetically conductive cap coupled to the yoke so as to substantially magnetically seal the magnetic air gap; and
legs coupling the shorted turn coil to the diaphragm, wherein the legs extend through holes in the cap.

13. The electromagnetic transducer of claim 1 wherein:
the yoke comprises a cup including a back plate portion and an outer cylinder portion;
the induction motor further includes, a magnetically conductive cap coupled to the yoke so as to substantially magnetically seal the magnetic air gap, and a center pole magnetically coupled to the back plate portion and to the cap;

the permanent magnet comprises at least one radially charged magnet segment disposed against one of an inner surface of the outer cylinder portion and an outer surface of the center pole;

the secondary coil is disposed against the other of the inner surface of the outer cylinder portion and the outer surface of the center pole;

wherein the magnetic air gap is between the permanent magnet and the primary coil.

14. The electromagnetic transducer of claim 13 wherein:

the center pole is of monolithic construction with the cap.

15. A loudspeaker induction motor comprising:

a cup having a back plate portion and an outer cylinder portion;

a polepiece disposed within the cup and having a first end magnetically coupled to the back plate portion;

a cap magnetically coupling a second end of the polepiece to the outer cylinder portion and having a plurality of holes therethrough;

a radially charged permanent magnet magnetically coupled against one of an inner surface of the cup and an outer surface of the polepiece;

an electrically conductive, multi-winding primary coil disposed against the other of the inner surface of the cup and the outer surface of the polepiece;

a short-circuited secondary coil disposed between the magnet and the primary coil;

a plurality of legs coupled to the secondary coil and each extending through a respective one of the holes through the cap;

wherein at least one of the cup, the polepiece, and the cap comprises powdered metal impregnated in a binding material.

16. The loudspeaker induction motor of claim 15 wherein:

at least two of the cup, the polepiece, and the cap are formed of powdered soft magnetic metal.

17. The loudspeaker induction motor of claim 16 wherein:

each of the cup, the polepiece, and the cap comprises powdered soft magnetic metal.

18. The loudspeaker induction motor of claim 15 wherein a powdered soft magnetic metal comprises:

powdered iron.

19. The loudspeaker induction motor of claim 15 wherein the secondary coil comprises:

only a single turn.

20. The loudspeaker induction motor of claim 15 wherein the motor comprises:

a compression driver.

21. The loudspeaker induction motor of claim 20 wherein the motor further comprises:

a phase plug formed of powdered soft magnetic metal.

* * * * *